US005098078A

United States Patent [19]

Nakanishi

[11] Patent Number: 5,098,078

[45] Date of Patent: Mar. 24, 1992

[54] CONTINUOUS PAPER LET-OUT APPARATUS

[75] Inventor: Tomoyuki Nakanishi, Moriyama, Japan

[73] Assignee: Omron Corporation, Kyoto, Japan

[21] Appl. No.: 509,153

[22] Filed: Apr. 16, 1990

[30] Foreign Application Priority Data

Apr. 17, 1989 [JP] Japan ..... 1-96740
Apr. 19, 1989 [JP] Japan ..... 1-99179

[51] Int. Cl.[5] ..... B65H 5/06

[52] U.S. Cl. ..... 271/10; 271/265; 271/273

[58] Field of Search ..... 271/4, 10, 109, 110, 271/119, 121, 125, 126, 262, 263, 265, 270–273

[56] References Cited

U.S. PATENT DOCUMENTS

| | | | |
|---|---|---|---|
| 3,881,718 | 5/1975 | Fernandez-Rana et al. | 271/10 |
| 4,570,801 | 2/1986 | Brannen | 271/4 |
| 4,607,832 | 8/1986 | Abe | 271/10 |
| 4,651,982 | 3/1987 | Martin | 271/4 |
| 4,753,433 | 6/1988 | Rodi et al. | 271/263 |
| 4,877,232 | 10/1989 | Nakanishi | 271/10 |
| 4,883,264 | 11/1989 | Yoshikawa et al. | 271/110 |
| 4,891,088 | 1/1990 | Svyatsky | 271/110 |

FOREIGN PATENT DOCUMENTS

| | | |
|---|---|---|
| 0295584 | 12/1988 | European Pat. Off. . |
| 2735932 | 2/1978 | Fed. Rep. of Germany . |
| 63-8133 | 1/1988 | Japan . |
| 63-200536 | 12/1988 | Japan . |

*Primary Examiner*—Joseph E. Valenza
*Assistant Examiner*—Steven M. Reiss
*Attorney, Agent, or Firm*—Dickstein, Shapiro & Morin

[57] ABSTRACT

The continuous paper let-out apparatus for letting out paper in sequence beginning from a first paper (2*a*) of a plurality of papers (2) accommodated under stacked condition, comprises let-out rollers (7), auxiliary rollers (6) and friction rollers (8). The let-out rollers (7) are in contact with an end of the first paper (2*a*) and let out this first paper when rotated. The auxiliary rollers (b 6) are brought into contact with a second paper (2*b*), after the first paper (2*a*) has been let out about half; and lets out the second paper (2*b*), when rotated, in partially overlapped positional relationship with respect to the first paper (2*a*). The friction rollers (8) are disposed opposingly to the let-out rollers (7); rotated at a circumferential speed lower than that of the let-out rollers (7); and shifts a second paper (2*b*) from the first paper, so that a partially overlapped portion of these two papers can be reduced, when brought into contact with the second paper.

7 Claims, 6 Drawing Sheets

CONTINUOUS PAPER LET-OUT APPARATUS

BACKGROUND OF THE INVENTION

1. Field of the Invention

The present invention relates generally to a continuous paper let-out apparatus for letting-out paper including bills, regular shape forms, etc. and more specifically to a continuous paper let-out apparatus provided within an automated teller machine, a cash dispenser, etc. for letting-out paper such as bills.

2. Description of the Prior Art

Conventionally, a paper let-out apparatus as shown in FIG. 8 has been known, in which a number of bills 2 are arranged roughly upright on a bill support plate 53 within a bill accommodating section 52. The bills 2 are urged toward a bill let-out direction by a pusher 54 movably disposed on the bill support plate 53 so as to be brought into pressure contact with let-out rollers 50 disposed in front of the bill accommodating section 52. When the let-out rollers 50 are rotated in the bill let-out direction, the stacked bills 2 are separated and let-out one by one sequentially by frictional resistance generated between a bill and friction rollers 51 disposed below the let-out rollers 50. The friction rollers 51 are interposed alternately between the two let-out rollers 50 in the axial direction in such a way that the circumference of the friction rollers 51 are partially overlapped with the circumferences of the let-out rollers 50 when seen from side. Further, the friction rollers 51 are permitted to rotate only in the direction opposite to the let-out direction.

In the above-mentioned prior-art paper let-out apparatus, however, since a number of bills are separated perfectly and then let out and conveyed one by one separately, there exists a problem in that bills tend to be skewed when being conveyed. In addition, where part or all of two or more bills are overlapped with each other, since this condition is detected as malseparation, there exists another problem in that it takes a long bill let-out time in case of malseparation, because bills must be once collected back into the bill accommodating section 52 and then separated and let out again one by one. Further, when a predetermined number of bills are discharged or collected, separated bills must be stacked in a bill stacking section. In this case, however, there arises another problem in that stacked bills are jammed (not arranged correctly) because the front end of a newly conveyed bill is brought into contact with the rear end of a bill already stacked at the bill stacking section. Furthermore, since bills are conveyed after having been perfectly separated one by one, the bill conveying path becomes inevitably long and therefore the size of the apparatus is relatively large.

SUMMARY OF THE INVENTION

With these problems in mind, therefore, it is the primary object of the present invention is to provide a continuous paper let-out apparatus which can improve the paper let-out efficiency, prevent paper from being skewed when let-out paper is being conveyed and from being jammed when let-out paper is stacked, and minimize the size of the apparatus.

To achieve the above-mentioned object, the continuous paper let-out apparatus, according to the present invention, for letting out paper in sequence beginning from a first paper of a plurality of papers accommodated under stacked condition, comprises: (a) let-out roller means, rotatably disposed in contact with an end of the first paper, for letting out the first paper; (b) auxiliary roller means, rotatable in synchronism with the let-out roller means and disposed at roughly a middle portion of paper and in contact with a second paper when the first paper is being let out by the let-out roller means, for letting out the second paper in partially overlapped positional relationship with respect to the first paper; and (c) friction roller means, rotatable in a let-out direction at a circumferential speed lower than that of the let-out roller means and disposed opposingly to the let-out roller means so as to be in contact with the second paper, for shifting the second paper a little from the first paper to reduce a partially overlapped portion of the two papers.

According to the present invention, since a plurality of papers can be let out continuously in such a way that one end portion of one paper is overlapped with the other end portion of the other paper, when a predetermined number of papers are temporarily stacked at the discharge section or the collecting section, it is possible to stop the first paper being conveyed at a predetermined position by a stopper and thereafter to smoothly and continuously stack the succeeding paper upon the stopped first paper. Therefore, it is possible to prevent the occurrence of paper jam and rejection when papers are stacked, thus allowing a predetermined number of papers to be smoothly let out for providing a smooth succeeding paper processing operation.

In addition, the conveying direction of papers can be maintained by the frictional resistance between two overlapped surfaces of plural papers, and the papers are conveyed under these overlap conditions, it is possible to prevent paper from being skewed during conveying process.

Further, since papers are conveyed in such a way as to be partially overlapped with each other, it is possible to shorten the length of the conveying path and therefore to reduce the size of the apparatus.

Further, to achieve the above-mentioned object, the continuous paper let-out apparatus, according to the present invention, for letting out paper in sequence beginning from a first paper of a plurality of papers accommodated under stacked condition, comprises: (a) let-out rollers, rotatably disposed in contact with one end of the first paper, for letting out the first paper; (b) auxiliary roller means, rotatable in synchronism with the let-out rollers and disposed at roughly a middle portion of paper and in contact with a second paper when the first paper is being let out by the let-out rollers, for letting out the second paper in partially overlapped positional relationship with respect to the first paper; (c) friction rollers, disposed opposingly to said let-out rollers and alternately interposed between the let-out rollers at appropriate intervals in such a way that a circumference of each let-out roller and a circumference of each friction roller are partially overlapped with each other when seen from side and further the partially overlapped width can be freely adjusted; (d) friction roller displacement means for supporting and moving the friction rollers in such a way that an overlap width between the let-out rollers and the friction rollers can be adjusted to any one of single paper let-out width and double paper let-out width; (e) guide roller means, disposed in front of the let-out rollers and rotatable at the same circumferential speed as that of the let-out rollers; (f) thickness detection means having thickness detection roller means movably supported so as to be urged into pressure contact with or separated from the guide roller means, for generating a single paper detection signal and a double paper detection signal on the basis of displacement degree of the thickness detection roller means; and (g) control means responsive to the thickness detection signal from the thickness detection means, for controlling the friction roller displacement means so that the overlap width between the let-out rollers and the friction rollers is set to a double paper let-out width in response to the single paper detection signal and to a single paper let-out width in response to the double paper detection signal.

According to the present invention, the overlap width between the let-out rollers and the friction rollers can be adjusted in response to the thickness detection signals from said thickness detection means, it is possible to continuously let out papers in sequence in such a way that two continuously conveyed papers can be partially overlapped with each other. Therefore, it is possible to effectively prevent the occurrence of paper skew trouble during paper conveying process and paper jam trouble at the paper stacking section, while reducing the length of the paper conveying path and therefore the size of the apparatus.

DETAILED DESCRIPTION OF THE PREFERRED EMBODIMENTS

Figure 1:
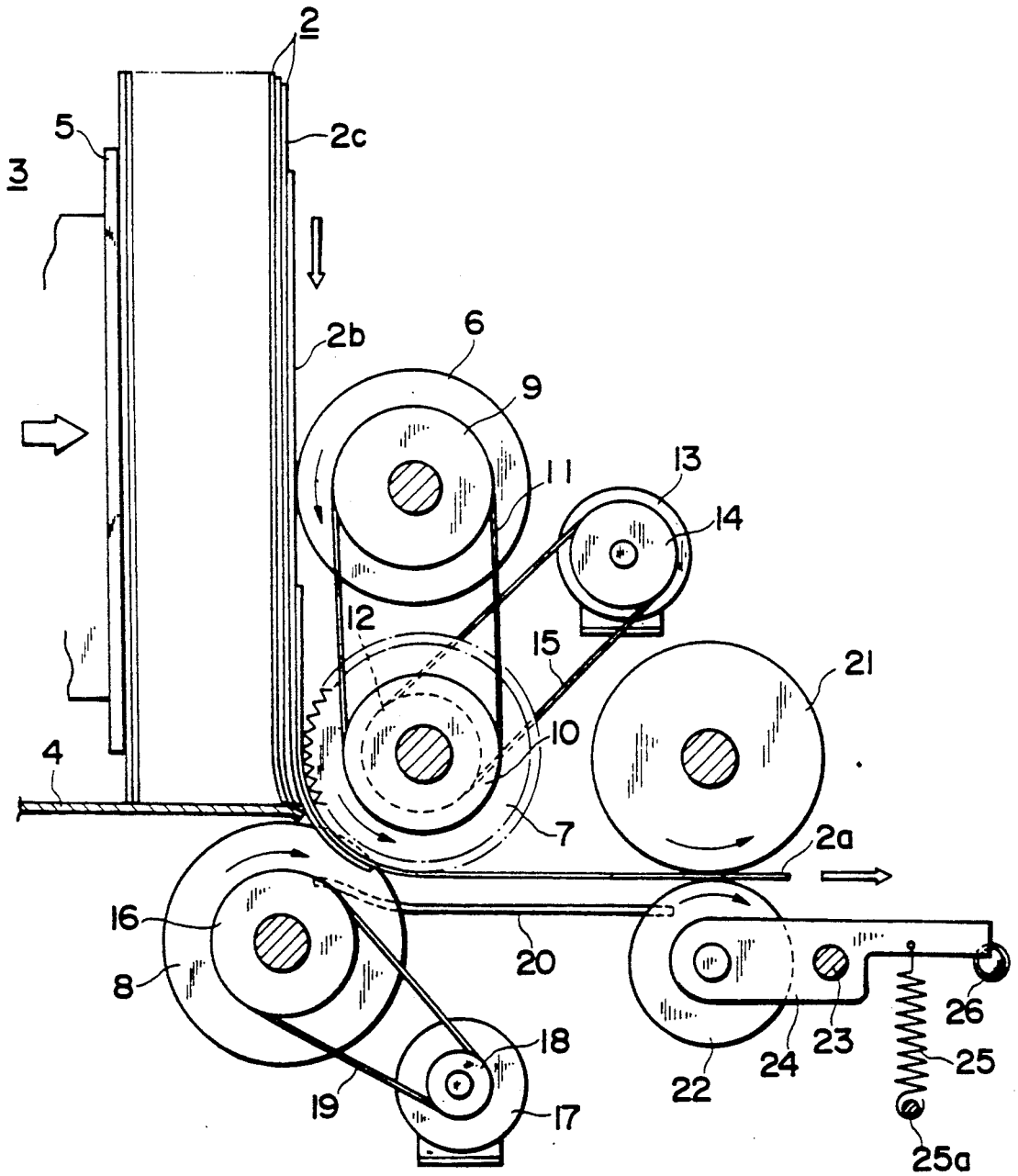
FIG. 1 is a partial side view showing an embodiment of the continuous paper let-out apparatus according to the present invention.

FIG. 1 shows an embodiment of the continuous paper let-out apparatus according to the present invention, in which bills are continuously let out.

A number of stacked bills 2 are arranged on a bill container 4 disposed horizontally within a bill accommodating section 3 by setting the bill transversal direction (the short side) upright. A pusher 5 is movably disposed on the bill container 4 to push the stacked bills 2 from the rear (left) side to the front (right) side. In front of the bill accommodating section 3, auxiliary rollers 6 are arranged on the upper side and let-out rollers 7 are arranged on the lower side. A front endmost (first) bill 2*a* of these plural bills 2 is brought into pressure contact with these rollers 6 and 7 by a push force of the pusher 5. That is, the let-out rollers 7 are disposed at such a position as to be in contact with the lower portion of the bills 2 and the auxiliary rollers 6 are disposed at such a position as to be in contact with the middle portion of the bills 2. Further, friction rollers 8 are disposed on the lower and rear side of the let-out rollers 7.

A driving belt 11 is reeved around a pulley 9 fixed coaxially to the auxiliary rollers 6 and another pulley 10 fixed coaxially to the let-out rollers 7. Further, another driving belt 15 is reeved around a pulley 12 fixed coaxially to the let-out rollers 7 and a pulley 14 fixed to an output shaft of a drive motor 13. Therefore, when the drive motor 13 is driven, the auxiliary rollers 6 and the let-out rollers 7 are rotated by these pulleys 9, 10, 12, 14 and these driving belts 11 and 15 at the same circumferential speed in the same bill let-out direction in synchronism with each other. A shaft to which the auxiliary rollers 6 are fixed and another shaft to which the let-out rollers 7 are fixed are both rotatably supported by a frame (not shown). Further, the drive motor 13 is also fixed to the same frame.

A driving belt 19 is reeved around a pulley 16 fixed coaxially to the friction rollers 8 and a pulley 18 fixed to an output shaft of another drive motor 17. Therefore, when the drive motor 17 is driven, the friction rollers 8 are rotated by these pulleys 16 and 18 and the driving belt 19 at a circumferential speed lower than that of the let-out rollers 7 in the same bill let-out direction. Similarly, a shaft to which the friction rollers 8 are fixed is rotatably supported by the frame, and the drive motor 17 is also fixed to the same frame.

The circumferential surfaces of the let-out rollers 7 and the friction rollers 8 are formed of a material such as a synthetic rubber having a relatively high friction coefficient. The let-out rollers 7 are formed into a small triangular-section of uneven circumferential shape, when seen from the side thereof.

Figure 2:
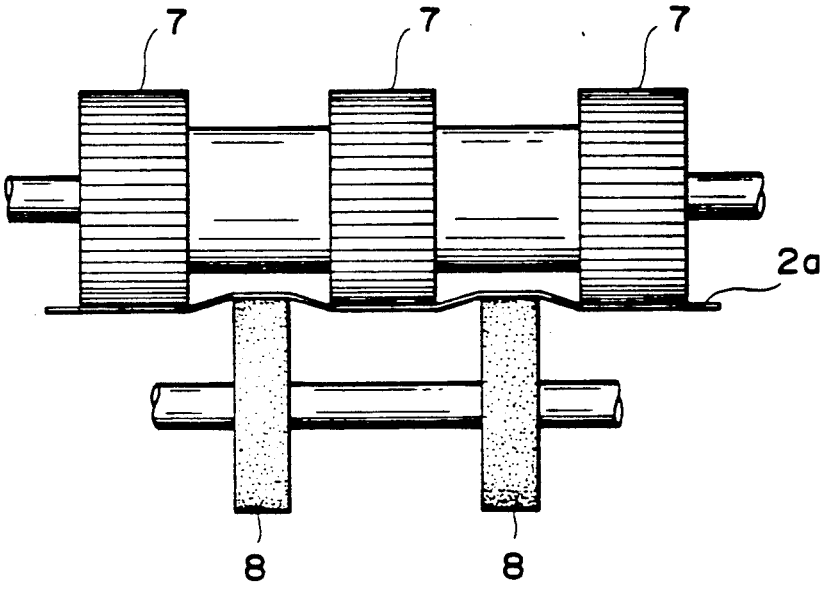
FIG. 2 is a front view showing an arrangement of the let-out rollers and the friction rollers.

As shown in FIG. 2, two friction rollers 8 are interposed alternately between the two let-out rollers 7 with appropriate intervals and further the circumference of each friction roller 8 is partially overlapped with that of each let-out roller 7 when seen from the side thereof. Therefore, a bill 2*a* pinched between these rollers 7 and 8 is waved as shown in FIG. 2.

In FIG. 1 again, a guide plate 20 is disposed extending along the conveying direction of a bill let-out from a position between the let-out rollers 7 and the friction rollers 8. In front of the guide plate 20, a guide roller 21 and thickness detection roller 22 are opposingly disposed so as to pinch the continuously let-out and conveyed bill from above and below along the conveying path. The guide roller 21 is driven by a driving motor (not shown) at the same circumferential speed and in the same let-out direction as the let-out rollers 7. The thickness detection roller 22 is rotatably supported by a rear end of a pivotal lever 24 supported by a pivotal pin 23 at the middle portion thereof. This pivotal lever 24 is urged by a coil spring 25 engaged between the pivotal lever 24 and a spring pin 25*a* in such a way that the thickness detection roller 22 is brought into pressure contact with the lowest circumferential surface of the guide roller 21. Further, the front end of the pivotal lever 24 is located within a detection range of a photoelectric thickness sensor 26 for detecting an inclination angle of the pivotal lever 24. Therefore, it is possible to count the number of let-out bills by counting the number of passing single or double bill portions on the basis of changes in thickness of bills passing through and between the guide roller 21 and the thickness detection roller 22. The pins 23 and 25*a* and the thickness sensor 26 are all fixed on the frame.

The operation of the continuous bill let-out apparatus thus constructed will be described hereinbelow.

When the drive motors 13 and 17 are activated, the auxiliary rollers 6 and the let-out rollers 7 are rotated at a constant circumferential speed in the same bill let-out direction in synchronism with each other. Therefore, a first (front endmost) bill 2*a* arranged in the bill accommodating section 3 is let out by a let-out force of the let-out rollers 7 and the auxiliary rollers 6. When the end of the first bill 2*a* is separated from the auxiliary rollers 6, since a second bill 2*b* is brought into contact with the auxiliary rollers 6, the second bill 2*b* is also let out in such a way as to be partially overlapped with the first bill 2*a*.

When the front end of the second bill 2*b* reaches the friction rollers 8, the second bill 2*b* is conveyed by the friction rollers 8. In this case, since the friction rollers 8 are rotating at a circumferential speed lower than that of the let-out rollers 7, the second bill 2*b* is conveyed at a speed lower than that of the first bill 2*a*, so that the two bills 2*a* and 2*b* are shifted along the conveying direction and therefore the overlap length between the first and second bills 2*a* and 2*b* decreases gradually. By appropriately determining the position of the auxiliary rollers 6 and a circumferential speed difference between the let-out rollers 7 and the friction rollers 8, it is preferable to convey bills under the condition that the overlap length between the first and second bills 2*a* and 2*b* becomes about $\frac{1}{3}$ of the transversal length (width) S of a single bill along the conveying direction, as shown in FIG. 3.

When the rear end of the second bill 2*b* is separated from the auxiliary rollers 6, a third bill 2*c* is let out by the auxiliary rollers 6 in the same way as described above, and is conveyed in partially overlapped positional relationship with respect to the second bill 2*b*. This third bill 2*c* is also shifted from the second bill 2*b* by the friction rollers 8 so that the overlap length becomes about S/3. Therefore, bills are continuously let out being overlapped with each other with an overlap length of about S/3, as shown in FIG. 3. Since the guide roller 21 is also rotated at the same circumferential speed and in the same conveying direction as the let-out rollers 7, these let-out bills are conveyed between the guide roller 21 and the thickness detection roller 22.

Figure 3:
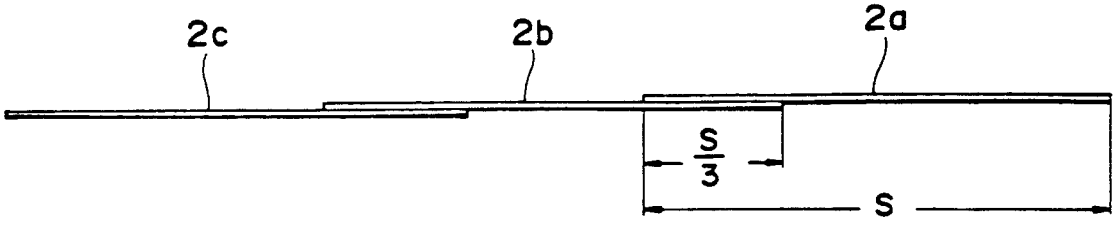
FIG. 3 is a side view showing continuously let-out papers for assistance in explaining that two papers are partially overlapped with each other.

Since the let-out bills conveyed are partially overlapped with each other, as shown in FIG. 3, a single bill and a double bill are detected alternately on the basis of the sensor signals of the photoelectric thickness sensor 26. Therefore, it is possible to count the number of let-out bills by counting the number of the single bill detections or double bill detections.

After a predetermined number of bills have been let out, the drive motors 13 and 17 are stopped, so that the auxiliary rollers 6, the let-out rollers 7 and the frictional rollers 8 all stop. In this case, since the front end of the last bill is pinched between the guide roller 21 and the thickness detection roller 22, and the guide roller 21 is still rotated, the last bill is conveyed frontward being pinched between the guide roller 21 and the thickness detection roller 22.

In front of the conveying path of the let-out bills, a bill stacking section is provided, and a projectable bill stopper (not shown) is disposed along the bill conveying path in the stacking section. Therefore, when the projectable bill stopper is projected beyond the conveying path, the conveyed bills are brought into contact with this stopper in sequence and are stacked thereat. In this case, since bills are conveyed in partially overlapped positional relationship with respect to each other, after a preceding bill has been stopped, a succeeding bill can be conveyed being easily slipped into a position with respect to the surface of the preceding bill into a stacked condition. As a result, the arrangement differs from prior-art apparatus, since no jamming occurs because the front end of the succeeding bill is brought into contact with the rear end of the preceding bill. Thus, it is possible with the present invention to smoothly stack the conveyed bills.

Further, since bills are conveyed continuously in partially overlapped condition, all the bills are conveyed as if a single lengthy bill were conveyed, it is possible to effectively prevent bills from being skewed during the conveying process. Further, since bills are conveyed continuously without being separated from each other, it is possible to reduce the length of the conveying path and therefore minimize the apparatus size.

Figure 4:
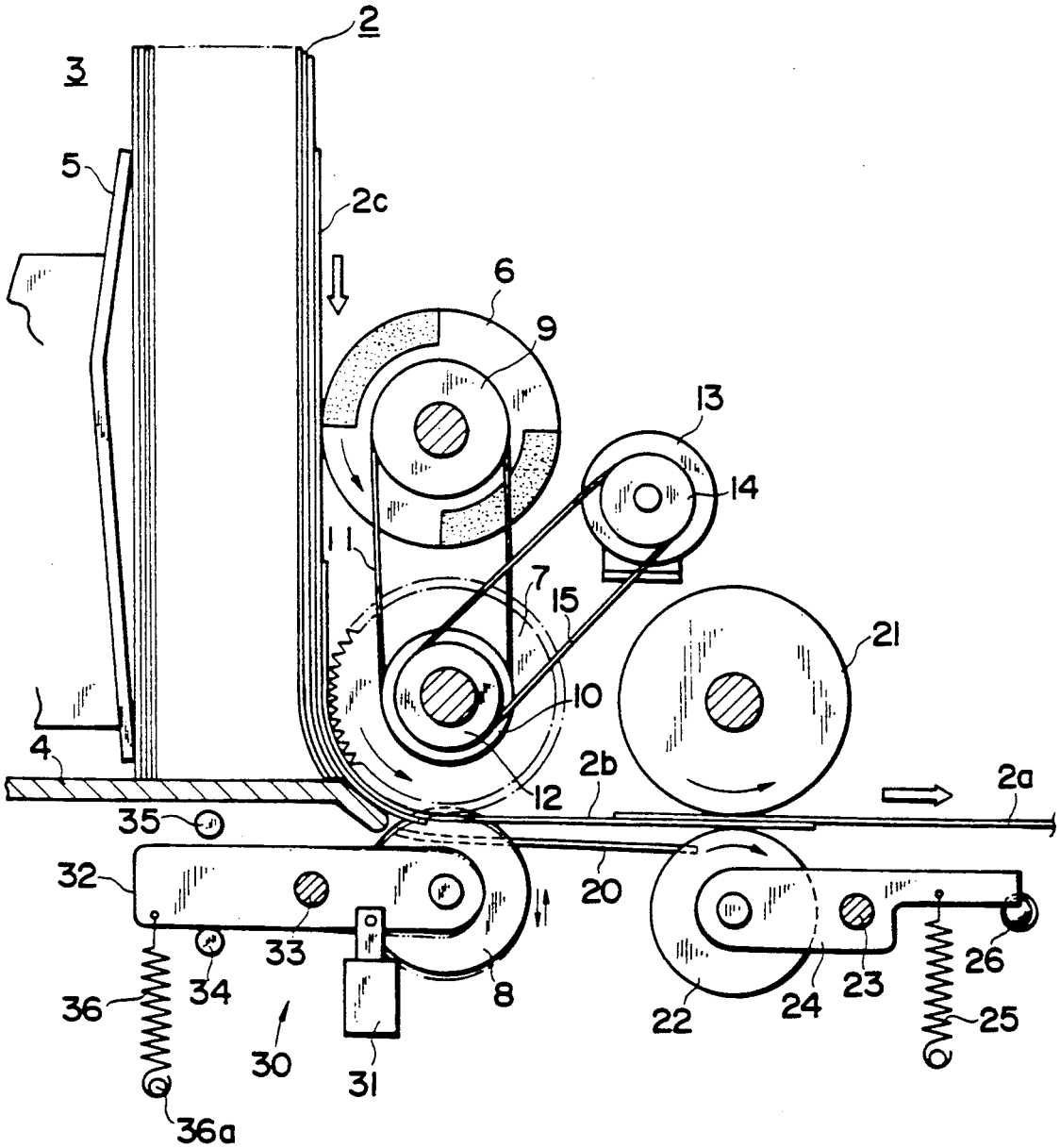
FIG. 4 is a partial side view showing another embodiment of the continuous paper let-out apparatus according to the present invention.

FIG. 4 shows another embodiment of the continuous paper let-out apparatus according to the present invention, in which the same reference numerals have been retained for similar elements which have the same functions, without repeating the detailed description thereof.

The auxiliary rollers 6 and the let-out rollers 7 are rotated by the drive motor 13 at the same speed in the same direction in synchronism with each other. The guide roller 21 is also rotated by another drive motor (not shown) at the same speed and in the same direction as these rollers 6 and 7. When the partial overlap length between two continuously let-out bills is determined to be about S/3 as shown in FIG. 3, a distance between the let-out rollers 7 and the guide roller 21 is determined to be about 2S/3 (S: the transversal width of a bill).

Figure 5A:
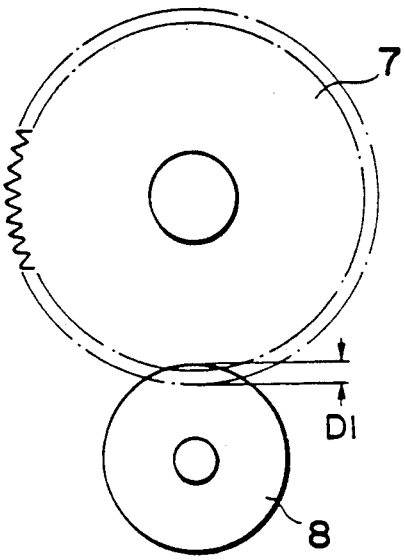
FIGS 5*a* and 5*b* are side views for assistance in explaining the overlap width between the let-out roller and the friction roller.

Being different from the first embodiment shown in FIG. 1, the friction rollers 8 are disposed so as to be movable up and down by means of a friction roller displacement mechanism 30. This friction roller displacement mechanism 30 comprises pivotal levers 32 pivotably supported by a pivotal pin 33 at the middle portion thereof, a coil spring 36 engaged between a rear end portion of the pivotal lever 32 and a spring pin 36*a* fixed to the frame (not shown), and a solenoid 31 connected to a front side of the pivotal lever 32. The friction rollers 8 are rotatably supported by the front end of the pivotal levers 32 and urged by the coil spring 36 toward the let-out rollers 7. A first friction roller position is determined when the rear end portion of the pivotal lever 32 is brought into contact with a stopper pin 34 fixed to the frame by the coil spring 36. The two friction rollers 8 are interposed between three let-out rollers in the same way as in the first embodiment shown in FIG. 2, and further the circumference of each friction roller 8 is partially overlapped with that of each let-out roller 7 when seen from the side thereof. The overlap width between the friction rollers 8 and the let-out rollers 7 at the first friction roller position is determined as D1 as shown in FIG. 5*a*. This first overlap width D1 is so determined that a single bill can be passed through between the let-out rollers 7 and the friction rollers 8 but two or more overlapped bills will not be passed therethrough.

Figure 5B:
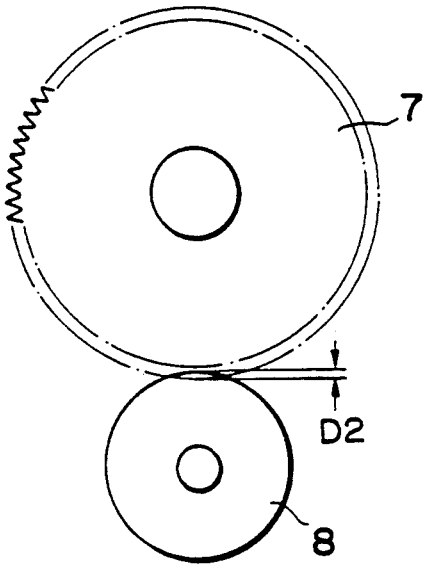

On the other hand, a second friction roller position is determined when the rear end portion of the pivotal lever 32 is brought into contact with a stopper pin 35 fixed to the frame by the solenoid 31 against an urging force of the coil spring 36 and therefore the friction rollers 8 are moved away from the let-out rollers 7. The overlap width between the friction rollers 8 and the let-out rollers 7 at the second friction roller position is determined as D2 as shown in FIG. 5*b*. This second overlap width D2 is so determined that two overlapped bills can be passed through between the let-out rollers 7 and the friction rollers 8 but three or more overlapped bills will not be passed therethrough. As described above, the friction rollers 8 are moved and located at any one of the first and second friction roller positions when the solenoid 31 is deenergized (the first position) or energized (the second position). Further, the friction rollers 8 rotate only in the direction opposite to the bill let-out direction, without rotating in the bill let-out direction.

Figure 6:
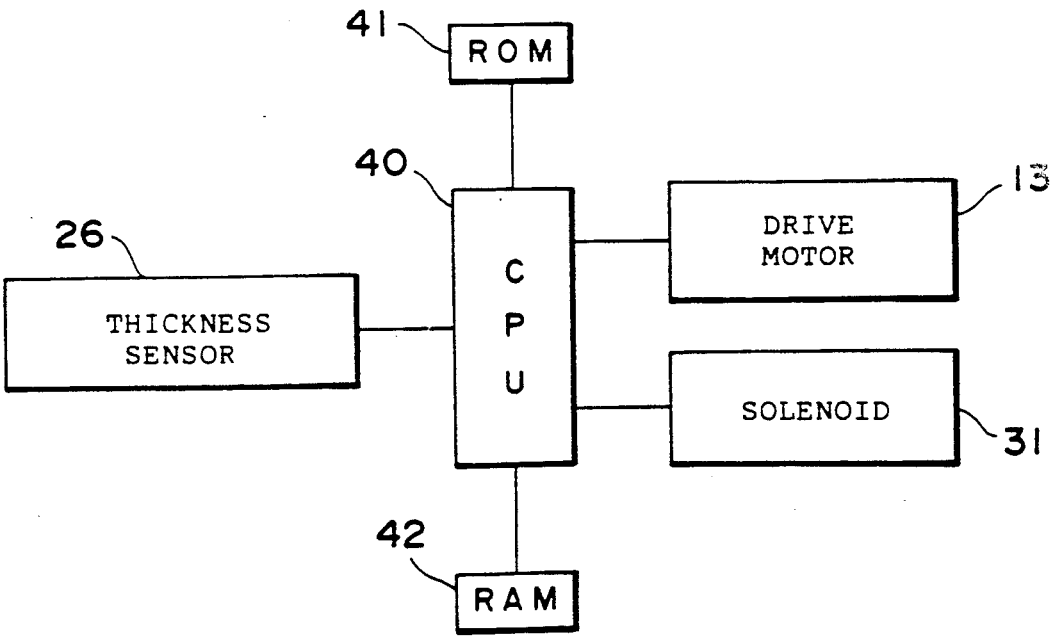
FIG. 6 is a block diagram showing an electric configuration of the controller incorporated in the continuous paper let-out apparatus of the present invention.

FIG. 6 is a block diagram showing a controller incorporated in the continuous paper let-out apparatus. The controller is controlled by a CPU 40. The CPU 40 controls various circuits and devices in accordance with programs stored in a ROM 41. Sensor signals generated by the photoelectric thickness sensor 26 are temporarily stored in a RAM 42 as bill counting data, and bill let-out processing is controlled on the basis of data stored in the RAM 42.

Figure 7:
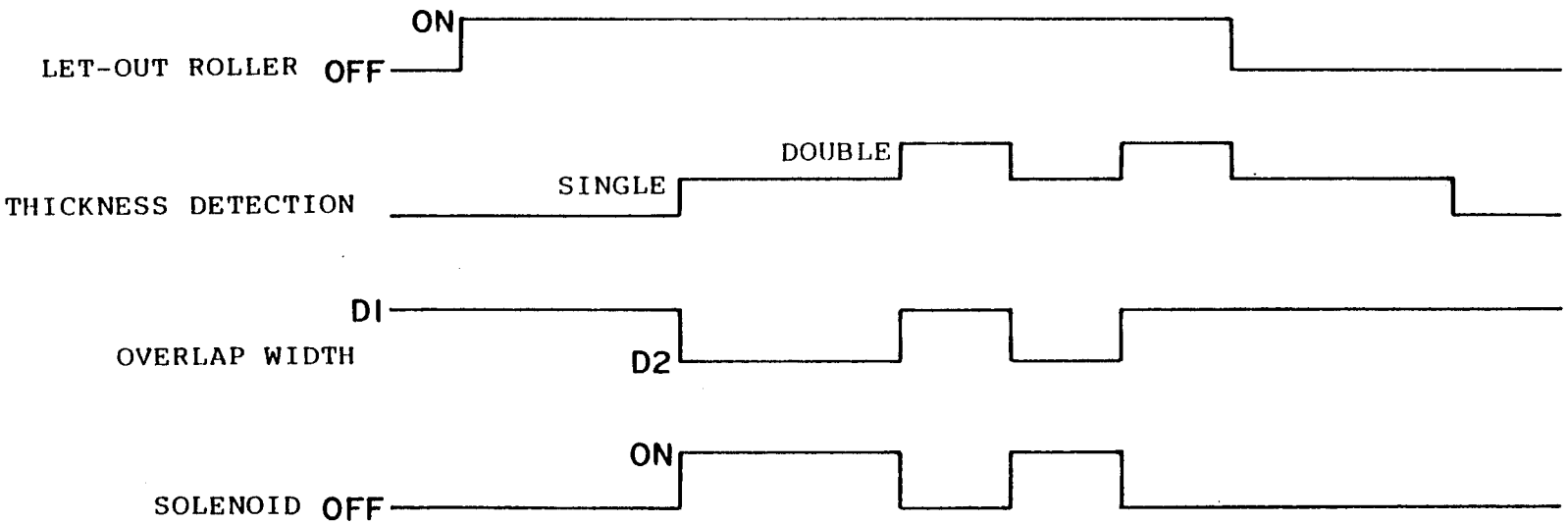
FIG. 7 is a timing chart for assistance in explaining the operation of the continuous paper let-out apparatus.
Figure 8:
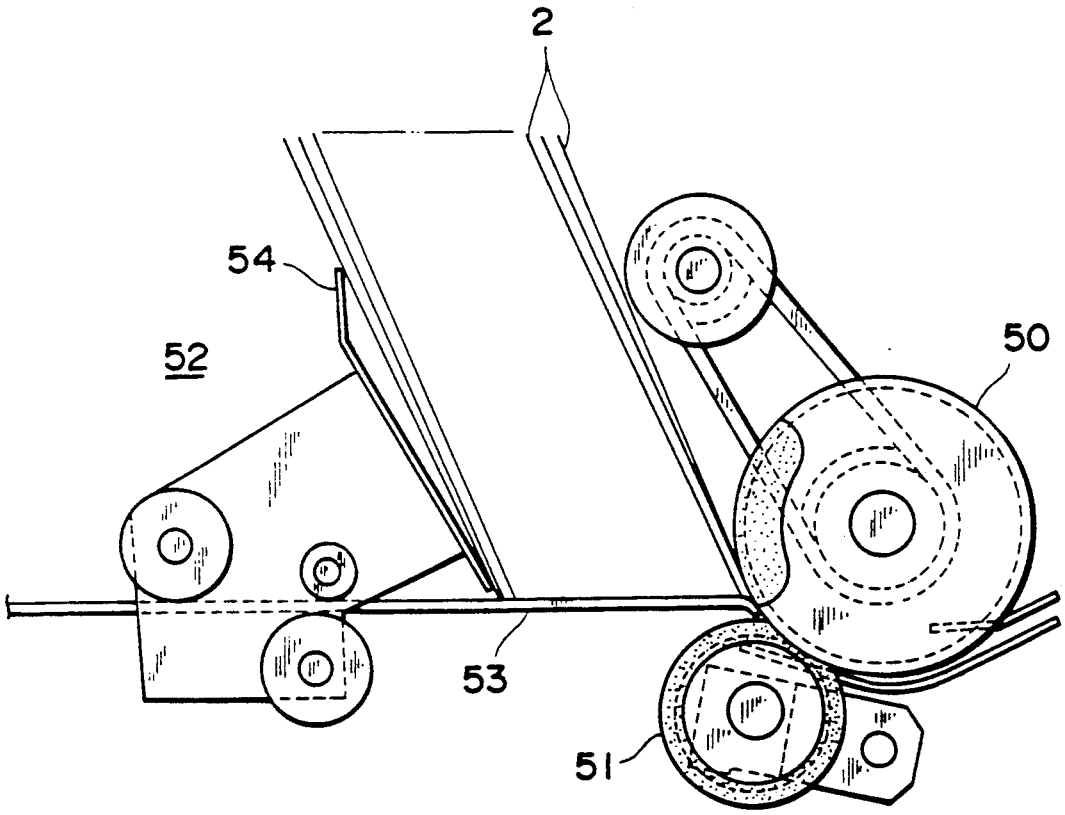
Fig. 8 PRIOR ART
FIG. 8 is a side view showing a prior-art paper let-out apparatus.

The operation of the continuous bill let-out apparatus of the present embodiment will be explained hereinbelow with reference to a timing chart shown in FIG. 7, in which three bills 2*a*, 2*b* and 2*c* are continuously let out as shown in FIG. 3.

First, the CPU 40 controls so that the number (three) of bills to be let out is stored in an area of the RAM 42. Thereafter, the CPU 40 activates the drive motor 13 to rotate the auxiliary rollers 6 and the let-out rollers 7 in synchronism with each other in the same let-out direction, so that a first (front endmost) bill 2*a* arranged in the bill accommodating section 3 is let out by a let-out force of the let-out rollers 7. When the rear end of the first bill 2*a* is separated away from the auxiliary rollers 6, a second bill 2*b* is next let out by the let-out force of the auxiliary rollers 6. In this case, since the overlap width between the let-out rollers 7 and the friction rollers 8 is set to a first overlap (single bill let-out) width D1, the first bill 2*a* can pass through between these rollers 7 and 8. However, since the second bill 2*a* let out thereafter cannot pass through between these rollers 7 and 8 due to a large frictional resistance generated therebetween, the second bill 2*a* is shifted relative to the first bill 2*a*. When the front end of the first bill 2*a* reaches the contact position between the guide roller 21 and the thickness detection roller 22, since the thickness detection roller 22 is pivoted downward a little according to the thickness of a single bill 2*a*, the photoelectric thickness sensor 26 detects the downward pivotal motion of the thickness detection roller 22 and outputs a single bill detection signal to the CPU 40. The CPU 40 counts a single bill let-out and stores this value in the RAM 42, while energizing the solenoid 31 to move the friction rollers 8 downward so that the overlap width between the let-out rollers 7 and the friction rollers 8 is set to a second overlap (double bill let-out) width D2. In the second overlap width D2, the two overlapped bills 2*a* and 2*b* can pass through between these rollers 7 and 8 because the frictional resistance of two overlapped bills 2*a* and 2*b* is reduced between these rollers 7 and 8. In this embodiment, since the distance between the guide roller 21 and the let-out rollers 7 is determined roughly 2S/3, the overlap length between the first bill 2*a* and the second bill 2*b* becomes about S/3 as shown in FIG. 3.

When the front end of the second bill 2*b* reaches the contact position between the guide roller 21 and the thickness detection roller 22, since the thickness detection roller 22 is pivoted downward according to the thickness of two overlapped bills 2*a* and 2*b*, the photoelectric thickness sensor 26 detects the downward pivotal motion of the thickness detection roller 22 and outputs a double bill detection signal to the CPU 40 until the rear end of the first bill 2*a* has passed therethrough.

In response to the double bill detection signal, since the CPU 40 deenergizes the solenoid 31, the friction rollers 8 are returned toward the let-out rollers 7 by the urging force of the coil spring 36, so that the overlap width between the let-out rollers 7 and the friction rollers 8 is returned to the first overlap width D1. Therefore, the third bill 2*c* let-out by the auxiliary rollers 6 and the let-out rollers 7 is shifted relative to the second bill 2*b* due to a large frictional resistance generated between the let-out rollers 7 and the friction rollers 8.

Then when the photoelectric thickness sensor 26 detects a single second bill 2*b* and outputs a single bill detection signal of the second bill 2*b*, the CPU 40 increments the number of bills.

As described above, since the overlap width between the let-out rollers 7 and the friction rollers 8 can be varied in response to the single and double bill detection signals generated by the photoelectric thickness sensor 26, it is possible to count the number of bills continuously let-out under the partially overlapped condition, by counting the number of single bill detection signals by the CPU 40.

When the photoelectric thickness sensor 26 detects the third bill 2*c* after the rear end of the second bill 2*b* has passed through between the guide roller 21 and the thickness detection roller 22, the let-out motion is stopped in response to the third single bill detection signal. That is, the CPU 40 deenergizes the solenoid 31 to return the friction rollers 8 toward the let-out rollers 7 so that the overlap width between these rollers 7 and 8 is returned to the first overlap width D1. Simultaneously, the motor 13 is deactivated to stop the rotations of the let-out rollers 7 and the friction rollers 8. In this case, since the front end of the third bill 2*c* reaches the contact position between the guide roller 21 and the thickness detection roller 22, the third bill 2*c* pinched between these rollers 21 and 22 is conveyed to the succeeding bill stacking section by the rotating guide roller 21.

A plurality of bills continuously let out as described above are stacked in the bill stacking section as with the case of the first embodiment.

As described above, since a plurality of bills are conveyed in partially overlapped positional relationship with respect each other, it is possible to prevent the occurrence of jamming at the bill stacking section and the occurrence of skew during the bill conveying process, and to reduce the length of the bill conveying path and therefore the size of the apparatus, as in the first embodiment.

Further, in FIG. 4, it is also possible to rotate the friction rollers 8 in the bill let-out direction at a circumferential speed lower than that of the let-out rollers 7. In this modification, a first pulley is disposed at the same position as the pivotal shaft 33; a second pulley is fixed coaxially to the friction rollers 8; a belt is reeved around these two pulleys; and the first pulley is driven by a drive motor.

I claim:

1. A continuous paper let-out apparatus for letting out paper in sequence beginning from a first paper of a plurality of papers accommodated under a stacked condition, comprising:

(a) let-out roller means, rotatably disposed in contact with an end of the first paper, for letting out the first paper;

(b) auxiliary roller means, rotating in synchronism with said let-out roller means said let-out roller means and auxiliary roller means being commonly driven by a first drive means and disposed at roughly a middle portion of paper and in contact with a second paper when the first paper is being let out by said let-out roller means, for letting out the second paper in partially overlapped positional relationship with respect to the first paper; and (c) friction roller means, rotatable by a second drive means in a let-out direction at a circumferential speed lower than that of said let-out roller means and disposed opposingly to said let-out roller means so as to be in contact with the second paper, for shifting the second paper from the first paper to partially reduce the overlap of the two papers.

2. The continuous paper let-out apparatus of claim 1, wherein a plurality of let-out roller means and a plurality of friction roller means are alternately interposed therebetween in an axial direction thereof, and a circumference of each let-out roller means and a circumference of each friction roller means are partially overlapped with each other when seen from a side.

3. The continuous paper let-out apparatus of claim 1, which further comprises thickness detection means for detecting a thickness of the let-out paper.

4. A continuous paper let-out apparatus for letting out paper in sequence beginning from a first paper of a plurality of papers accommodated under a stacked condition, comprising:

(a) let-out rollers, rotatably disposed in contact with an end of the first paper, for letting out the first paper;

(b) auxiliary rollers rotating in synchronism with said let-out rollers by a common drive motor and disposed at roughly a middle portion of paper and in contact with a second paper when the first paper is being let out by said let-out rollers, for letting out the second paper in partially overlapped positional relationship with respect to the first paper;

(c) friction rollers, disposed opposingly to said let-out rollers and alternately interposed between said let-out rollers at appropriate intervals in such a way that a circumference of each let-out roller and a circumference of each friction roller are partially overlapped with each other when seen from a side whereby said partially overlapped circumference forms an overlap width which can be freely adjusted;

(d) friction roller displacement means for supporting and moving said friction rollers in such a way that said overlap width between said let-out rollers and said friction rollers can be adjusted by said friction roller displacement means to any one of a single paper let-out width and a double paper let-out width;

(e) guide roller means, disposed in front of said let-out rollers and rotatable at the same circumferential speed as that of said let-out rollers for guiding the let-out papers away from said let-out apparatus;

(f) thickness detection means having thickness detection rollers means movably supported so as to be urged into pressure contact with or separated from said guide roller means, for generating a single paper detection signal and a double paper detection signal on the basis of a displacement degree of said thickness detection roller means; and (g) control means responsive to the thickness detection signal from said thickness detection means, for controlling said friction roller displacement means so that the overlap width between said let-out rollers and said friction rollers is set to a double paper let-out width in response to the single paper detection signal and to the single paper let-out width in response to the double paper detection signal.

5. The continuous paper let-out apparatus of claim 4, wherein said friction rollers are rotatable only in a direction opposite to said paper let-out direction.

6. The continuous paper let-out apparatus of claim 4, further comprising means for rotating said friction rollers in a paper let-out direction at a circumferential speed lower than that of said let-out rollers.

7. The continuous let-out paper apparatus of claim 4, wherein said friction rollers are non-driven.

* * * * *